United States Patent [19]

Endo et al.

[11] Patent Number: 4,494,502

[45] Date of Patent: Jan. 22, 1985

[54] IDLING CONTROLLER OF VARIABLE DISPLACEMENT ENGINE

[75] Inventors: Norio Endo; Yoshiaki Danno; Tatsuro Nakagami; Nobuaki Murakami, all of Kyoto, Japan

[73] Assignee: Mitsubishi Jidosha Kogyo Kabushiki Kaisha, Tokyo, Japan

[21] Appl. No.: 456,782

[22] Filed: Jan. 10, 1983

[30] Foreign Application Priority Data

| | | | |
|---|---|---|---|
| Jan. 27, 1982 | [JP] | Japan | 57-12447 |
| Nov. 16, 1982 | [JP] | Japan | 57-200908 |
| Dec. 14, 1982 | [JP] | Japan | 57-218907 |

[51] Int. Cl.[3] ..... F02D 17/02

[52] U.S. Cl. ..... 123/198 F; 123/580

[58] Field of Search ..... 123/198 F, 481, 580

[56] References Cited

U.S. PATENT DOCUMENTS

| | | | |
|---|---|---|---|
| 4,098,252 | 7/1978 | Abthoff et al. | 123/198 F |
| 4,200,083 | 4/1980 | Ishida | 123/198 F |
| 4,207,856 | 6/1980 | Sugasawa et al. | 123/481 |
| 4,257,371 | 3/1981 | Ishida | 123/198 F |

*Primary Examiner*—Ira S. Lazarus

*Attorney, Agent, or Firm*—Robert E. Burns; Emmanuel J. Lobato; Bruce L. Adams

[57] ABSTRACT

An idling controller for a variable displacement engine which is capable of operating either in a partial-cylinder or an all-cylinder mode by varying the number of cylinders in operation. When the engine runs at idle, the idling controller assures optimum operation for either cylinder operating mode by varying the quantity of air intake according to the number of cylinders in operation, providing an improvement in both fuel mileage and strating performance, one or the other of which has had to be sacrified conventionally.

10 Claims, 12 Drawing Figures

IDLING CONTROLLER OF VARIABLE DISPLACEMENT ENGINE

BACKGROUND OF THE INVENTION

1. Field of the Invention

This invention relates to a variable displacement engine that is capable of varying the number of operating cylinders by bringing part of the engine cylinders into an idling state during operation. More particularly, it relates to an idling controller that regulates and controls the idling condition of a variable displacement engine.

2. Description of the Prior Art

To prevent the generation of noxious gases through the improvement of combustion efficiency and to achieve better gasoline mileage by raising the load factor and, thereby, decreasing pumping losses, variable displacement engines of conventional designs cause part of their cylinders to idle while the engines are being run under low load by, for example, closing the intake and exhaust valves of some cylinders.

But there has been a problem of unstable operation with these conventional variable displacement engines. With their throttle valve opened to the same extent when the engine is running at idle, greater power is developed when only part of the cylinders are used than when all cylinders are operated. As a consequence, the revolutions of the engine crankshaft decreases as the partial-cylinder mode is switched to the all-cylinder mode without actuating the accelerator with no load applied, creating an unstable engine operation.

In contrast with this, when an engine that is operated with appropriate crankshaft revolutions in the all-cylinder mode is switched to the partial-cylinder mode, engine speed will increase excessively.

It is, of course, possible to maintain the all-cylinder mode throughout the idling period, attaching greater importance to the starting performance than to the fuel efficiency, or to maintain the partial-cylinder mode when importance is placed the other way around. But this practice cannot be implemented without sacrificing either the starting performance or fuel efficiency.

SUMMARY OF THE INVENTION

The object of this invention is to solve such an antinomic problem or, more specifically, to provide an idling controller for use with a variable displacement engine that permits achieving both fuel saving and starting performance enhancement by securing an appropriate idling condition at all times, whether the engine is operated in the all-cylinder mode or in the partial-cylinder mode.

To achieve this object, an idling controller according to this invention comprises means to stop the operation of part of the cylinders of a multi-cylinder engine that is provided to the cylinders whose operation is to be stopped, means to control the number of operating cylinders during idling by supplying control signals to said cylinder operation stopping means, means to adjust the flow-rate of air supplied to the combustion chamber of each cylinder, the means being provided in the intake passage through which the air flows into the combustion chamber, and means to control the flow-rate of air, the means increasing or decreasing the quantity of the intake air according to the number of the cylinders in operation during idling by controlling said air flow-rate adjusting means in conformity with the action of said cylinder number controlling means.

With this construction, the variable displacement engine idling controller of this invention offers great utility because it permits individually controlling the idling engine speed under the all-cylinder and partial-cylinder operating conditions without using the accelerator pedal, thereby achieving both fuel saving and starting performance enhancement.

Furthermore, the idling controller also realizes a smooth, vibration-free engine operation by preventing a decrease in engine crankshaft revolutions that occurs as the engine operation is shifted from one mode to another.

DESCRIPTION OF THE PREFERRED EMBODIMENTS

Now, preferred embodiments of this invention will be described in detail by reference to the accompanying drawings.

Figure 1:
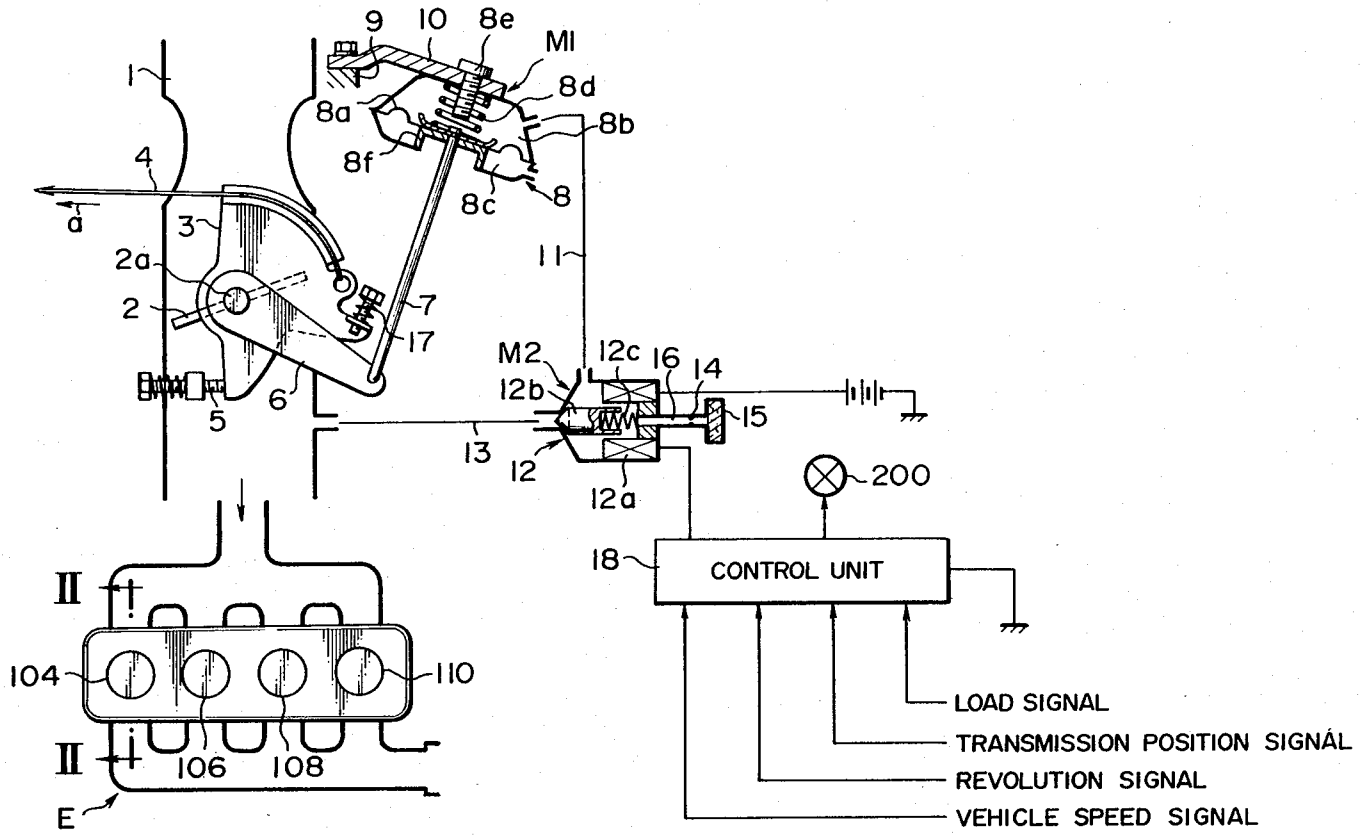
FIG. 1 is a schematic illustration outlining the construction of a first preferred embodiment of this invention.
Figure 2:
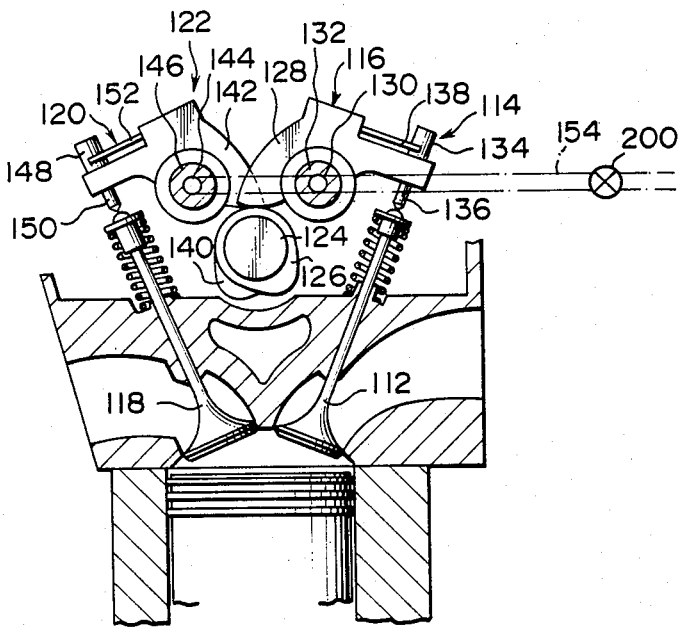
FIG. 2 is a cross-section looking in the direction of the arrow II of FIG. 1.

FIG. 1 shows an in-line four-cylinder automotive engine E of the variable displacement type comprising two suspendable cylinders (i.e., the first and fourth cylinders 104, 110 on the outside) whose operation can be stopped depending upon the operating condition of the engine (e.g., during a low-load operation) and two continuous-service cylinders (i.e., the second and third cylinders 106, 108 on the inside) that continue their operation irrespective of the engine operating condition. With this switchable cylinder arrangement, the variable displacement engine E is capable of operating with either four cylinders (the all-cylinder mode) or two cylinders (the partial-cylinder mode) working. An intake valve actuating device and an exhaust valve actuating device of the known type are provided to the second and third cylinders 106, 108 of the engine. Meanwhile, an intake valve actuating device 116 having a valve stopping mechanism 114 to stop the operation of an intake valve 112 and an exhaust valve actuating device 122 having a valve stopping mechanism 120 to stop the operation of an exhaust valve 118 are provided to the first and fourth cylinders 104, 110, as shown in FIG. 2.

The intake valve actuating device 116 comprises an intake cam 126 attached to a cam shaft 124, an intake rocker arm 128 swung by the motion of said intake cam 126, a rocker shaft 132 pivotally supporting said intake rocker arm 128 and having an oil passage 130 formed therethrough, and the valve stopping mechanism 114 which is supported by the intake rocker arm 128 and functions as a means to stop the operation of a relevant cylinder. The valve stopping mechanism 114 comprises a cylinder 134 fastened to the intake rocker arm 128, a plunger 136 slidably fitted in the cylinder 134, a stopper 138 that allows the plunger 136 to slide within the cylinder 134 when pressurized oil is supplied through the oil passage 130 and holds the plunger 138 in a projected position when the oil pressure in the oil passage 130 drops, and a spring, not shown, which is provided in the cylinder 134 to urge the plunger 136 toward the projecting direction.

The exhaust valve actuating device 122 comprises an exhaust cam 140 attached to a cam shaft 124, an exhaust rocker arm 142 swung by the motion of said exhaust cam 140, a rocker shaft 146 pivotally supporting said exhaust rocker arm 142 and having an oil passage 144 formed therethrough, and the valve stopping mechanism 120 which is supported by the exhaust rocker arm 142 and functions as a means to stop the operation of a relevant cylinder. The valve stopping mechanism 120 comprises a cylinder 148 fastened to the exhaust rocker arm 142, a plunger 150 slidably fitted in the cylinder 148, a stopper 152 that allows the plunger 150 to slide within the cylinder 148 when pressurized oil is supplied through the oil passage 144 and holds the plunger 150 in a projected position when the oil pressure in the oil passage 144 drops, and a spring, not shown, which is provided in the cylinder 148 to urge the plunger 150 toward the projecting direction.

The oil passages 130, 144 are connected to a pressurized oil supply source (such as a lubricating oil pump), not shown, through an oil passage 154 in a rocker cover. The supply and discharge of pressurized oil to and from the oil passages 130, 144 are effected by controlling a solenoid control valve 200 provided in the oil passage 154. The solenoid control valve 200 is designed to supply pressurized oil to the oil passages 130, 144 when a solenoid coil, not shown, gets excited and stop the supply of oil thereto when the solenoid coil becomes deenergized.

A throttle valve 2 is provided downstream of the carburetor venturi section in an intake passage 1 through which air is supplied to the combustion chamber of the cylinders 104, 106, 108, 110.

There are also provided a throttle-valve opening-area switching device M1 adapted to put the throttle valve 2 in either a first opening position (the position shown in FIG. 1) or a second opening position providing a larger opening than the first position (the position shown in FIG. 3) when the engine is running at idle and a throttle-valve opening-area controlling device M2 that supplies control signals to the throttle-valve opening-area switching device M1 so that the throttle valve 2 takes the first opening position in the two-cylinder operating mode and the second opening position in the four-cylinder operating mode.

The following paragraphs provide a concrete description of the throttle-valve opening-area switching device M1 and the throttle-valve opening-area controlling device M2. To the shaft 2*a* of the throttle valve 2 is attached a first lever 3 that turns therewith. To the first lever 3 is connected a wire 4 that is pulled in the arrow-indicated direction a when an accelerator pedal (not shown) is depressed. When the accelerator pedal is depressed, therefore, the wire 4 is pulled, whereby the first lever 3 is turned counterclockwise to open the throttle valve 2.

When the depressing force on the accelerator pedal is removed, a return spring not shown turns the throttle valve 2 clockwise into the closing position.

The clockwise movement of the first lever 3 is limited by a first speed adjusting screw (hereinafter called the first screw) 5, which serves as a first stopper fastened to the throttle body. Consequently, the throttle valve 2 takes the first opening position when the first lever 3 comes in contact with the first screw 5 while the engine is running at idle.

A second lever 6 loosely fitted on the shaft 2*a* is turned by a throttle opener 8 which is a pressureresponsive mechanism linked to the opposite end of the second lever 6 through a rod 7 provided therebetween.

The throttle opener 8 is supported by the engine side 9 through an arm 10, and has chambers 8*b*, 8*c* which are separated from each other by a diaphragm 8*a* to which the rod 7 is attached.

A compression spring 8*d* is set in the chamber 8*b*.

One end of a passage 11 opens into the chamber 8*b*, with the other end of the passage 11 connected to a solenoid three-way valve 12.

The three-way valve 12 connects with a passage 13 which communicates with that portion of the intake passage 1 which is downstream of the throttle valve 2 and supplies an intake manifold vacuum that serves as a second pressure signal and a passage 16 which communicates with the atmosphere through an air filter 15 and supplies atmospheric pressure that serves as a first pressure signal. The on-off action of a solenoid coil 12*a* and the action of a return spring 12*c* in the three-way valve 12 actuate a plunger 12*b*, whereby the intake manifold vacuum or atmospheric pressure is supplied to the chamber 8*b*.

The pressure inside the chamber 8*c* is kept atmospheric.

Stoppers 8*e*, 8*f* to restrict the movement of the rod 7 through the diaphragm 8*a* are provided in the chambers 8*b*, 8*c* respectively.

To the first lever 3 is attached a second speed adjusting screw (hereinafter called the second screw) 17 serving as a second stopper. When turning counterclockwise in FIG. 1, the second lever 6 comes in contact with the second screw 17 which, in turn, turns the first lever 3 and throttle valve 2 through the second screw 17.

Figure 3:
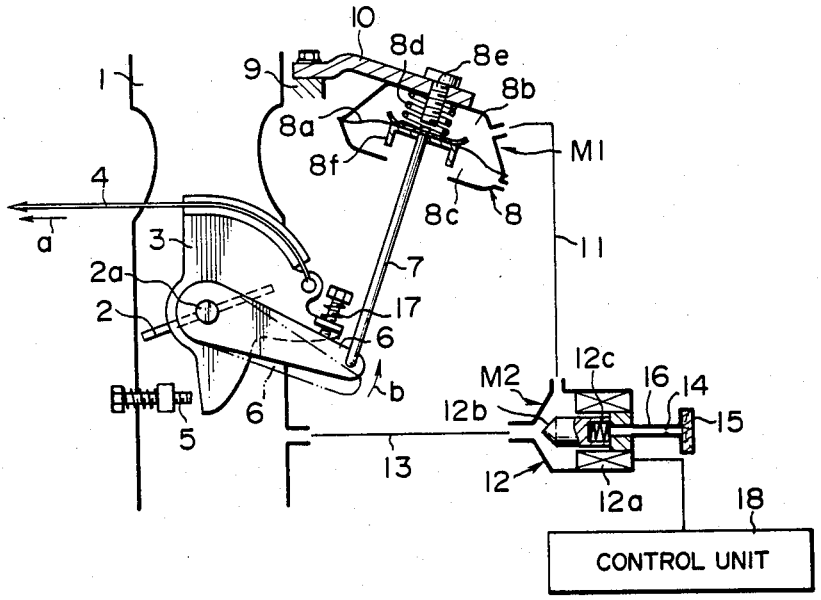
FIG. 3 is a schematic illustration showing the operation of the first preferred embodiment.

When the intake manifold vacuum developed by the idling engine is supplied to the chamber 8*b* of the throttle opener 8, the rod 7 is pulled up, thereby turning the second lever 6 counterclockwise, as indicated by the arrow b in FIG. 3, and the first lever 3 also in the same direction through the second screw 17. As a consequence, the throttle valve 2 opens to a greater extent than in the first opening position described before. That is, when the engine runs at idle, the throttle valve 2 takes the second opening position that provides a larger opening than the first opening position (see FIG. 3). At this time, the first lever 3 is away from the first screw 5.

When atmospheric pressure is supplied to the chamber 8*b* of the throttle opener 8, the rod 7 is pushed down to cause the second lever 6 to get detached from the second screw 17. Consequently, a return spring, not shown, brings the first lever 3 into contact with the first screw 5, thereby putting the throttle valve 2 into the first opening position when the engine is running at idle.

By thus varying the pressure in the chamber 8*b* of the throttle opener 8, the throttle valve 2 can be put into either the first or second opening position while the engine is running at idle.

Figure 4:
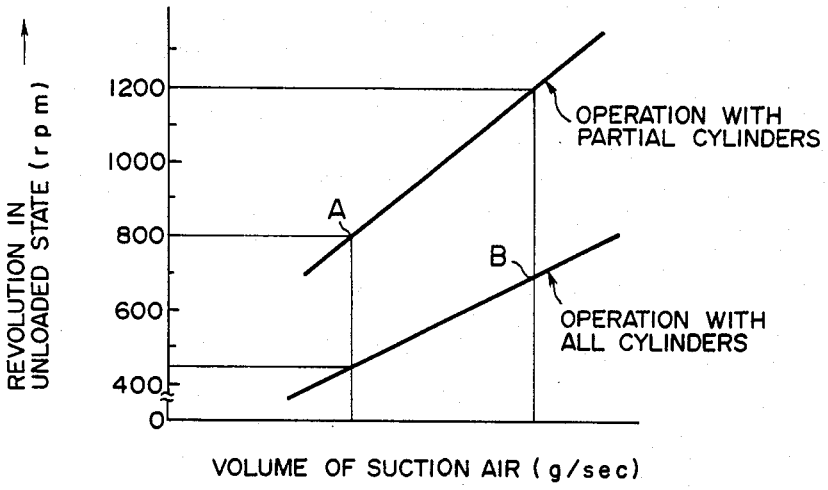
FIGS. 4, 5—(*a*) through (*c*)—, and 6 are graphs showing the operation of the first preferred embodiment.

When the engine is operated with no load applied in the lower rpm region, the rpm characteristic in relation to the air intake passing through the throttle valve 2 differs in the all- and partial-cylinder modes, as shown in FIG. 4. When the transmission is in a neutral position while the engine is idling, it is preferable to operate the engine in the partial-cylinder mode or with two cylinders working to achieve fuel saving. When the gear is shifted to first speed, in preparation for start, better start can be attained by operating the engine in the all-cylinder mode or with four cylinders working. With a 1,400 cc displacement engine, for example, stalling and undesirable vibration can be prevented if the two-cylinder idling is effected at approximately 800 rpm as indicated by A in FIG. 4. Meanwhile, better start and fuel saving can be achieved if the four-cylinder idling is effected at approximately 700 rpm as indicated by B in FIG. 4.

In order to secure the preferable rpm's of approximately 800 for the two-cylinder idling and approximately 700 for the four-cylinder idling, an appropriate quantity of air, which differs from one mode to the other, must be supplied to the engine combustion chamber. When the engine runs at idle, the two-cylinder operation requires less intake air than the four-cylinder operation.

The appropriate supply of air can be ensured by controlling the throttle opener 8 so that the throttle valve 2 takes the first opening position to reduce the supply of intake air when the engine runs with two cylinders working and the second opening position to supply more intake air when the engine runs with four cylinders working.

The three-way valve 12 is provided in order to realize this control; the solenoid coil 12*a* of the three-way valve 12 is connected to the control output side of a control unit 18.

Receiving signals representing engine load, transmission position, engine speed, car speed, etc. as inputs, the control unit 18 determines whether the engine should be run in a two-cylinder or four-cylinder mode. If a need to operate four cylinders exists, the control unit 18 outputs an exciting signal to the solenoid coil 12*a*. Then, the plunger 12*b* is actuated to supply intake manifold vacuum to the chamber 8*b*, whereupon the throttle valve 2 takes the second opening position to bring engine speed to a level appropriate for four-cylinder idling. As will be evident from the above description, the second screw 17 is adjusted so that an appropriate engine speed is obtained in the four-cylinder idling mode.

When it is necessary to operate with two cylinders, the control unit 18 outputs a de-energizing signal to the solenoid coil 12*a*, whereupon the spring 12*c* moves the plunger 12*a* in the opposite direction to allow atmospheric pressure to flow into the chamber 8*b* with the vacuum in the chamber 8*b* being released into the atmosphere. Then, the throttle valve 2 takes the first opening position to bring engine speed to a level appropriate for two-cylinder idling. As will be understood from the above description, the first screw 5 is adjusted so that an appropriate engine speed is obtained in the two-cylinder idling mode.

The control unit 18 is connected to the solenoid coil 12*a* to constitute the control section of the air intake controlling means in conjunction with the three-way valve 12. The control unit 18 is also connected to a solenoid coil, not shown, in the solenoid control valve 200 mentioned above to constitute the cylinder number controlling means in conjunction with the solenoid control valve 200. The control unit 18 outputs an energizing signal to the solenoid coil of the solenoid control valve 200 when a need to operate two cylinders is acknowledged and a de-energizing signal to the same solenoid coil when a need to operate four cylinders is recongnized.

With a 1,400 cc displacement engine, the crankshaft revolution and intake manifold vacuum respectively stand at approximately 700 rpm and 500 mmHg when the engine runs at idle with four cylinders working. In the two-cylinder idling operation, the crankshaft revolution and intake manifold vaccum respectively stand at approximately 800 rpm and 400 mmHg. When the engine operating mode is switched from four-cylinder idling to two-cylinder idling by switching the three-way valve 12 to the atmosphere side, the intake manifold vacuum, which is incapable of quick change, remains at approximately 500 mmHg even after the engine has been shifted to the two-cylinder operation mode. As a consequence, sufficient torque will not be developed, engine speed will drop as shown in FIG. 5(*a*), and, in the worst case, the engine will stop its operation.

To solve this problem, a contraction 14 is provided in the atmosphere side passage 16. This contraction allows the vacuum in the throttle opener 8 to be released into the atmosphere gradually, thereby permitting a gradual shift of the throttle valve from the second opening position to the first opening position. This reduces the decrease in engine speed during the transition period as shown in FIG. 5(*b*), assuring a smooth shift.

Figure 5A:
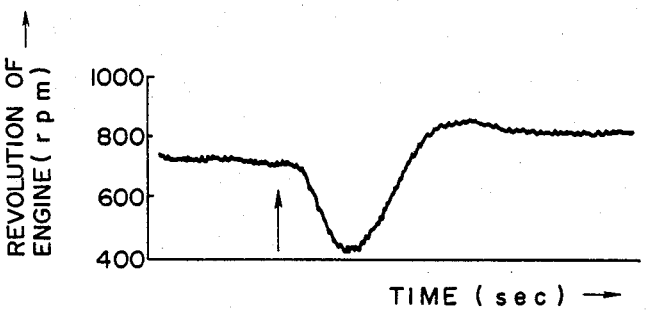
Figure 5B:
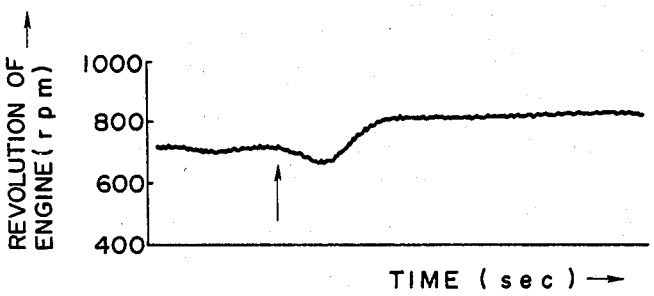
Figure 5C:
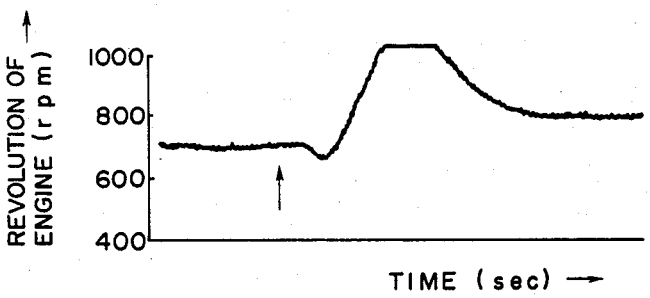
Figure 7:
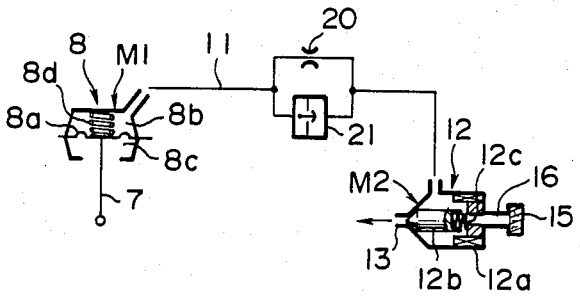
FIG. 7 is a schematic illustration outlining the construction of a second preferred embodiment of this invention.

The contraction 14 should not be overmuch, or an undesirably large overshoot would result as shown in FIG. 5(*c*). Therefore the contraction 14 is set so that an appropriate contraction value is obtained.

Conversely, when the engine operation is switched from two-cylinder idling to four-cylinder idling by turning the three-way valve 12 to the intake manifold vacuum side, the intake manifold vacuum will remain approximately 400 mmHg even after the switch to four-cylinder idling has been accomplished, momentarily increasing engine speed. The increased engine speed, however, soon draws close to the steady state as indicated by a solid line in FIG. 6 because less air is taken in than in the steady state due to some delay in the response of the throttle opener 8 (which occurs although no contraction is provided in the passage 13).

Figure 6:
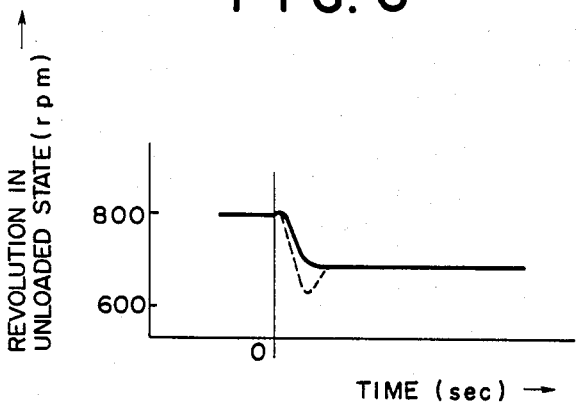

If the motion of the throttle opener 8 is intentionally delayed, an overshoot to decrease engine speed will occur as indicated by a dotted line in FIG. 6. In switching from two-cylinder idling to four-cylinder idling, therefore, it is preferable to actuate the throttle opener 8 quickly, even if engine speed increases momentarily. This is the reason why no contraction is provided in the passage 13.

Then, when the transmission is in neutral while the car is at a standstill with the acceleration pedal not depressed, the control unit 18 outputs, based on the load and rpm signals, an energizing signal to the solenoid coil of the solenoid control valve 200 and a de-energizing signal to the solenoid coil 12*a* so that a two-cylinder operating condition is established.

At this time, pressurized oil is supplied to the oil passages 130, 144, bringing the intake and exhaust valves of the two suspendable cylinders 104, 110 out of operation and thereby implementing a partial-cylinder mode engine operation.

Also, the chamber 8*b* of the throttle opener 8 is opened to the atmosphere through the three-way switch valve 12 as shown in FIG. 1. The second lever 6 in the lowered position keeps the first lever 3 at a standstill in contact with the first screw 5. All this brings the throttle valve 2 in the first opening position, whereby the engine runs at idle with two cylinders with their crankshafts turning at a rate of approximately 800 rpm.

On making the car ready for start by depressing the clutch pedal to shift the transmission from neutral to first speed (the lowest forward speed), the control unit 18 outputs a de-energizing signal to the solenoid coil of the solenoid control valve 200 and an energizing signal to the solenoid coil 12*a* so that a four-cylinder operating condition is attained.

Then, the supply of pressurized oil to the oil passages 130, 144 is discontinued to bring the intake and exhaust valves of the two suspendable cylinders 104, 110 back into an operable condition, thereby making the engine ready for an all-cylinder mode operation. Consequently, intake manifold vacuum (or a vacuum control signal) is quickly supplied through the three-way switch valve 12 to the chamber 8*b* of the throttle opener 8, thereby pulling up the rod 7, turning the second lever 6 counterclockwise in FIGS. 1 and 3, and quickly opening the throttle valve 2 to a greater extent through the second screw 17 and the first lever 3 (see FIG. 3). This causes the throttle valve 2 to shift quickly from the first opening position to the second opening position, thereby making it possible to achieve a four-cylinder idling at approximately 700 rpm even during the transition period, without suffering from any significant drop in engine speed.

On reversing the transmission to neutral, the control unit 18 outputs the signals for the two-cylinder operation to the solenoid coil of the solenoid control valve 200 and the solenoid coil 12*a* of the three-way switch valve 12. Then, the intake and exhaust valves of the suspendable cylinders 104, 110 are brought out of operation again, with the three-way switch valve 12 opened to the atmosphere.

As a consequence, the vacuum in the chamber 8*b* of the throttle opener 8 is gradually released to the atmosphere through the three-way switch valve 12 and the contraction 14. Namely, atmospheric pressure is gradually supplied to the chamber 8*b* to push down the rod 7, as a consequence of which the first lever 3 is turned clockwise in FIG. 3 by the action of the return spring not shown and the opening of the throttle valve 2 is gradually decreased until the first lever 3 comes in contact with the first screw 5 (see FIG. 1). This causes the throttle valve 2 to move gradually from the second opening position to the first opening position, thereby allowing the engine to perform a two-cylinder idling at approximately 800 rpm during the transition period, without experiencing any significant drop in engine speed.

The throttle opener 8 actuates the second lever 6 even in other operation modes than idling. Even if actuated, however, the second lever 6 will safely remain out of contact with the second screw 17 since the wire 4 pulls the first lever 3 counterclockwise while the car is running.

Substantially the same effect or advantage will be gained as in the preferred embodiment just described if a contraction 20 and a check valve 21 are provided in parallel in the passage 11 between the throttle opener 8 and the three-way switch valve 12 so that the throttle valve 8 can be actuated quickly when vacuum is supplied and gradually when vacuum is released.

Also, a delay circuit capable of varying delay time may be provided to adjust the supply of signals from the control unit 18 to the solenoid coil 12*a* so that a shift from the first opening position to the second opening position is effected quickly and a shift in the opposite direction gradually.

A pulse motor or other types of motor may be used as the throttle valve opening switching device M1, as well.

The throttle valve 2 in the above-described preferred embodiment, which serves as the air intake adjusting valve actuated by the pressure-responsive mechanism, may be replaced by a throttle bypass valve as in other preferred embodiments described hereunder. The members which are the same as or similar to those in the first embodiment will not be described in detail and represented by like reference numerals.

Figure 8:
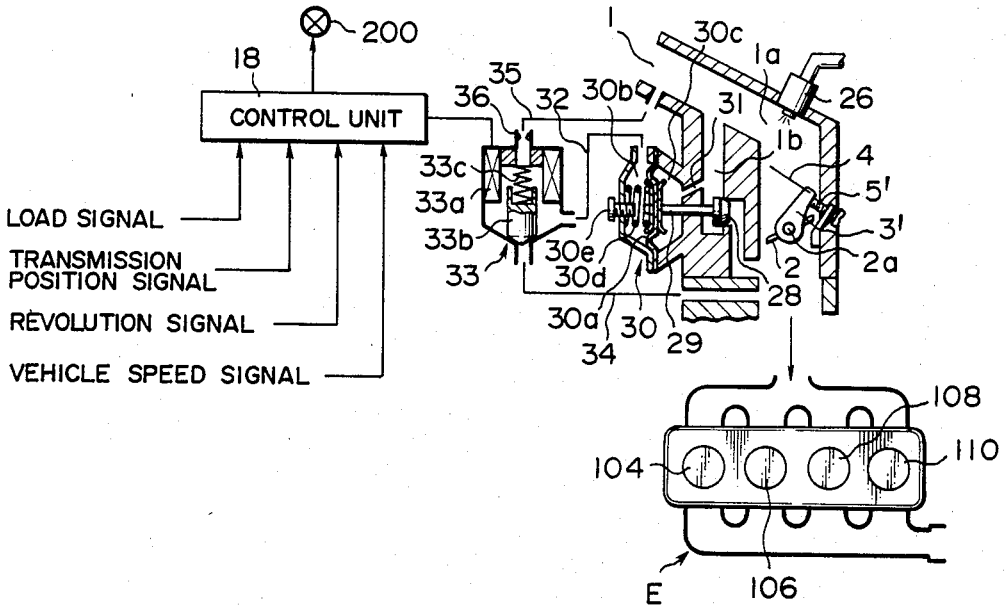
FIG. 8 is a schematic illustration outlining the construction of a third preferred embodiment of this invention.

The engine E shown in FIG. 8 receives the supply of fuel from a low-pressure fuel injection system that replaces the carburetor. A throttle valve 2 is provided in the intake passage 1. To the shaft 2*a* carrying the throttle valve 2 is attached an integrally rotating lever 3', to which, in turn, is attached a wire 4 that is connected to an accelerator pedal not shown. As the driver depresses the accelerator pedal, the wire 4 moves the throttle valve 2 in the opening direction through the lever 3'. When the accelerator pedal is not depressed, the throttle valve 2 is urged by a return spring, not shown, in the closing direction, thereby keeping the lever 3' in contact with an adjust screw 5' (to minimize the opening of the throttle valve 2).

A fuel injection valve 26 is provided in that portion of the intake passage which is upstream of the throttle valve 2. The upstream end of the intake passage communicates with the atmosphere through an air intake flowmeter and an air cleaner not shown. The quantity of fuel to be supplied from the fuel injection valve 26 is determined based on the signal representing the flow rate of intake air measured by the air intake flowmeter and signals representing other operating conditions (such as engine speed, throttle valve opening, cooling water temperature, and intake air temperature).

The intake passage 1 has the bypass section 1*b* which bypasses the main section 1*a*, in which the throttle valve 2 and the fuel injection valve 26 are provided, to connect those portions of the intake passage which are upstream and downstream of the main section 1*a*. A bypass valve 28 is provided in the bypass section 1*b*. Accordingly, some of the intake air supplied to each combustion chamber of the engine E passes through the throttle valve 2 and some through the bypass valve 28. The bypass valve 28 is coupled to the diaphragm 30*a* of a pressure-responsive device 30 through a coupling member 29. The pressure-responsive device 30 has chambers 30*b* and 30*c* that are separated from each other by the diaphragm 30*a*. While the chamber 30*b* communicates with those portions of the intake passage which are upstream and downstream of the throttle valve 2 through a communicating passage 32 and a three-way switch valve 33, the chamber 30*c* constitutes an atmosphere chamber communicating with the bypass section 1*b* upstream of the bypass valve 28 through a communicating passage 31. In the chamber 30*b* are provided a spring 30*d* that urges the bypass valve 28 in the closing direction through the diaphragm 30*a* and an adjust screw 30*e* that sets the maximum opening position of the bypass valve 28. When vacuum is not supplied to the chamber 30*b*, the bypass valve 28 is urged by the spring 30*d* into the first or minimum opening position (i.e., the totally closing position in this case). When vacuum is supplied to the chamber 30*b*, the bypass valve 28 moves to the second or maximum opening position.

The three-way switch valve 33 has a plunger 33*b* which normally closes, by the action of a spring 33*c*, the opening leading to a vacuum passage 34 connecting the three-way switch valve 33 with that portion of the intake passage which is downstream of the throttle valve 2. When the solenoid coil 33*a* becomes energized, the plunger 33*b* moves upward in FIG. 8, resisting the urging force of the spring 33*c*, to close the opening leading to an atmosphere passage 35 connecting the three-way switch valve 33 with that portion of the intake passage which is upstream of the throttle valve 2.

Let's assume that the engine runs at idle at approximately 800 rpm with two cylinders working and at approximately 700 rpm with four cylinders working. As shown in FIG. 4, it is necessary to supply more air during four-cylinder idling than during two-cylinder idling. In the embodiment being described, air intake is increased during four-cylinder idling by opening the bypass valve 28, and air intake is decreased during two-cylinder idling by closing the bypass valve 28.

The three-way switch valve 33 is provided to realize this switching. The solenoid coil 33*a* of the three-way switch valve 33 is connected to the control output side of the control unit 18. When the need for two-cylinder idling arises, the control unit 18 outputs a de-energizing signal to the solenoid coil 33*a*. With the plunger 33*b* urged downward in FIG. 8 by the spring 33*c*, the opening on the side of the vacuum passage 34 is closed and the opening on the side of the atmosphere passage 35 is opened. Consequently, atmospheric pressure is supplied to the chamber 30*b* to allow the air supply to the combustion chamber of the cylinders in operation only through the throttle valve 2, with the bypass valve 28 totally closed. This provides an engine speed appropriate for two-cylinder idling (approximately 800 rpm). As will be understood from this description, the adjust screw 5' is set so that such an appropriate engine speed is obtained during two-cylinder idling.

When the need for all-cylinder or four-cylinder idling arises, the control unit 18 outputs an energizing signal to the solenoid coil 33*a*. This signal actuates the plunger 33*b* to supply intake manifold vacuum to the chamber 30*b*, whereby the bypass valve 28 is moved to the maximum opening position set by the adjust screw 30*e*. As a result, air is supplied to the combustion chamber of every cylinder through the throttle valve 2 and the bypass valve 28, thereby providing an engine speed appropriate for four-cylinder idling (approximately 700 rpm). As will be understood from the above description, the adjust screw 30*e* sets the quantity of air that is added to the air whose quantity is set by the adjust screw 5' (the air which is supplied through the throttle valve 2) in order to secure as much air as is necessary for the attainment of an engine speed appropriate for four-cylinder idling.

A contraction 36 is provided in the atmosphere passage 35. Like the contraction 14 provided in the embodiment shown in FIG. 1, the contraction 36 is also provided to achieve a gradual decrease of air intake essential for the prevention of an engine speed drop that would otherwise occur when four-cylinder idling is switched to two-cylinder idling. The gradual decrease is accomplished by slowly closing the bypass valve 28 by gradually releasing the vacuum from the chamber 30*b* of the pressure-responsive device 30 into the atmosphere. The contraction 36 decreases the engine speed drop associated with the switching from four-cylinder idling to two-cylinder idling, as shown in FIG. 5(*b*).

Because no contraction is provided in the vacuum passage 34, by contrast, manifold vacuum is quickly supplied to the chamber 30*b* when two-cylinder idling is switched to four-cylinder idling, whereby the bypass valve 28 is quickly opened to permit a quick intake of air. Therefore, engine speed on this occasion changes as indicated by a solid line in FIG. 6.

Figure 9:
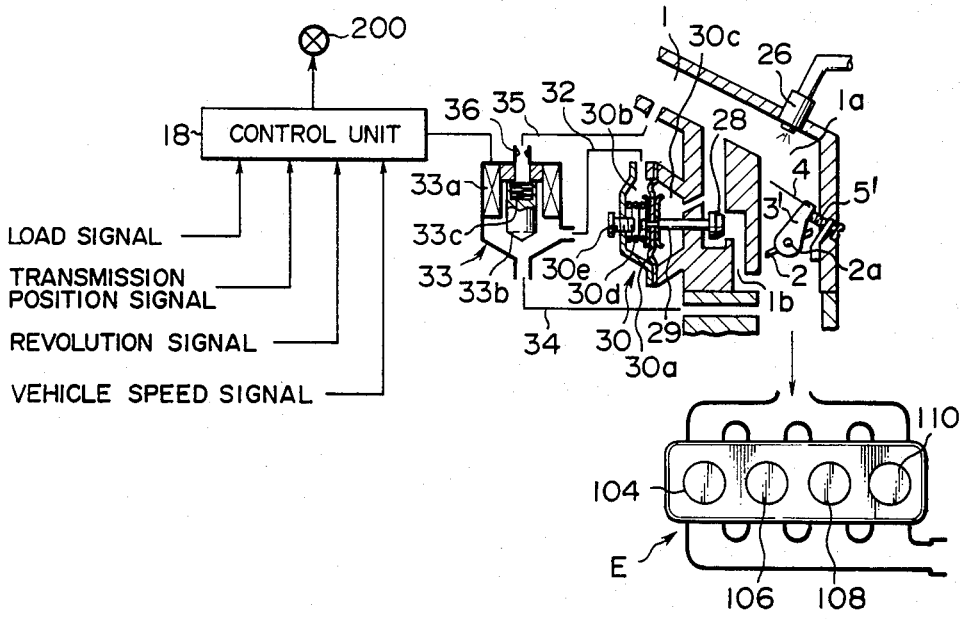
FIG. 9 is a schematic illustration showing the operation of the third preferred embodiment.
Figure 10:
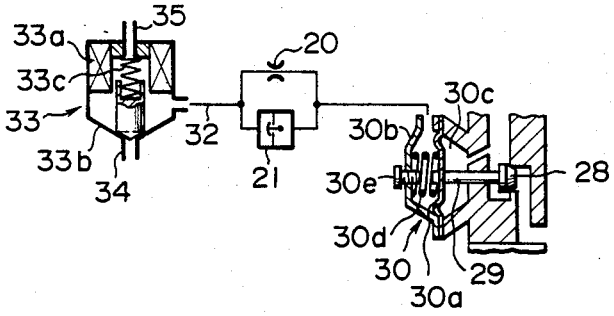
FIG. 10 is a schematic illustration outlining the construction of a fourth preferred embodiment of this invention.

When the control unit 18 sends forth signals for two-cylinder idling, the bypass valve 28 takes the minimum opening position as shown in FIG. 8, thereby permitting the engine to idle with two cylinders at approximately 800 rpm. When the control unit 18 outputs signals for four-cylinder idling, the bypass valve 28 takes the maximum opening position as shown in FIG. 9, thereby allowing the engine to idle with four cylinders at approximately 700 rpm. Furthermore, smooth operation mode shifts are ensured without any engine speed drop because the bypass valve 28 is quickly opened when two-cylinder idling is switched to four-cylinder idling and the same valve 28 is gradually closed when the operation mode is switched in the opposite direction.

In the embodiment just described, the upstream ends of the bypass section 1*b* and the main section 1*a* of the intake passage jointly communicate with the atmosphere through a single air cleaner. But the upstream ends of the bypass section 1*b* and the main section 1*a* may be allowed to communicate individually with the atmosphere through different air cleaners. In this case, only the air passing through the main section 1*a* is measured by use of an intake flowmeter. By then correcting the measurement according to the opening condition of the bypass valve 28, the quantity of air supplied to the combustion chamber of each cylinder is calculated. Then, finally, the quantity of fuel to be supplied through the fuel injection valve 26 is determined.

In the above-described embodiment, the contraction 36 is provided in the atmosphere passage 35 in order to prevent an engine speed drop that would otherwise occur when four-cylinder idling is switched to two-cylinder idling. Approximately the same effect or advantage may be obtained if a contraction 20 and a check valve 21 are provided in parallel in the passage 32, in place of the contraction 36 in the atmosphere passage 35. This provision will allow the manifold vacuum from the vaccum passage 34 to be quickly supplied to the chamber 30*b* through the check valve 21 and contraction 20 and the atmosphere from the atmosphere passage 35 to be gradually supplied to the chamber 30*b* through the contraction 20 alone.

Also, a delay circuit capable of varying delay time may be provided to adjust the supply of signals from the control unit 18 to the solenoid coil 33*a* so that the bypass valve 28 is opened quickly and closed gradually.

A pulse motor or other types of motor may be used in place of the pressure-sensitive device 30 for the actuation of the bypass valve 28.

This invention is applicable not only to the four-cylinder variable displacement engine but also to other multi-cylinder variable displacement engines.

What is claimed is:

1. An idling controller for a variable displacement engine comprising:

a plurality of cylinders of a multi-cylinder engine into each of which a fuel-air mixture is supplied through a common manifold and a common air intake passage, cylinder operation stopping means to stop the operation of part of said cylinders by cutting off the supply of the intake air to said part of cylinders, cylinder number controlling means to control the number of operating cylinders during idlying by supplying such control signals to said cylinder operation stopping means as switching the engine operation between an all-cylinder idling mode wherein all cylinders operate and a partial-cylinder idling mode wherein said part of cylinders operate while the other(s) remain inoperative, air flow-rate adjusting means which is provided in said common air intake passage in order to adjust the flow-rate of intake air passing through said common air intake passage, and air flow-rate controlling means to increase or decrease the quantity of the intake air according to the number of the cylinders in operation during idling by controlling said air flow-rate adjusting means so that the quantity of the intake air passing through said common air intake passage during said partial cylinder idling mode is less than that during all-cylinder idling mode, in conformity with the action of said cylinder number controlling means.

2. An idling controller for a variable displacement engine according to claim 1, in which said air flow-rate controlling means controls said air flow-rate adjusting means so that engine speed is higher during partial-cylinder idling than during all-cylinder idling.

3. An idling controller for a variable displacement engine according to claim 1, in which said air flow-rate adjusting means comprises an air flow-rate adjusting valve interposed in said intake passage and said air flow-rate controlling means comprises means to switch the opening of said air flow-rate adjusting valve during idling between a first opening position and a second opening position which provides a greater opening than the first position and a control section that supplies to said valve opening switching means actuating signals in response to the control action of said cylinder number controlling means, said valve opening switching means placing, in conformity with the actuating signals supplied from said control section, said air flow-rate adjusting valve in the first opening position during partial-cylinder idling and in the second opening position during all-cylinder idling.

4. An idling controller for a variable displacement engine according to claim 3, in which said actuating signals are supplied from said control section to said valve opening switching means so that said air flow-rate adjusting valve is moved quickly from the first opening position to the second opening position and gradually from the second opening position to the first opening position.

5. An idling controller for a variable displacement engine according to claim 4, in which said valve opening switching means comprises a pressure-responsive mechanism to change the position of said air flow-rate adjusting valve, the pressure-responsive mechanism being engaged with the air flow-rate adjusting valve and actuated by pressure signals, and said control section comprises a first pressure passage through which a first pressure signal to place said air flow-rate adjusting valve in the first opening position is supplied to said pressure-responsive mechanism, a second pressure passage through which a second pressure signal to place said air flow-rate adjusting valve in the second opening position is supplied to said pressure-responsive mechanism, means to supply and control pressure controlling the supply of pressure signals through said first and second pressure passages in conformity with the control action of said cylinder number controlling means, and a contraction provided in the first pressure passage, said second pressure signal being supplied quickly to said pressure-responsive mechanism through the second pressure passage and said first pressure signal being supplied gradually to said pressure-responsive mechanism through the first pressure passage.

6. An idling controller for a variable displacement engine according to claim 5, in which said air flow-rate adjusting valve comprises a throttle valve provided in said intake passage.

7. An idling controller for a variable displacement engine according to claim 5, in which said, intake passage comprises a main section through which air is supplied to said combustion chambers by way of a throttle valve provided therein and a bypass section through which air is supplied to said combustion chambers bypassing said throttle valve, the downstream end of the bypass section communicating with said main section downstream of said throttle valve, and said air flow-rate adjusting valve comprises a bypass valve provided in said bypass section of the intake passage.

8. Control system for a multi-cylinder variable displacement engine having a common air intake passage and a common fuel-air manifold for supplying a fuel-air mixture to all of the cylinders, each of said cylinders having an intake valve for admitting fuel-air mixture from said common manifold to the cylinder and an exhaust valve for exhausting combustion products from the cylinder to an exhaust system, said control system comprising:

means for deactivating the intake valve of part of said cylinders so that fuel-air mixture is not drawn into said cylinder for part cylinder operation of the engine, means variable controlling the effective cross sectional area of said common air intake passage, and means jointly controlling said intake valve deactivating means and said air intake passage varying means to decreased the effective cross sectional area of said common air intake passage when the engine is operating in an idling mode and the intake valve of part of the cylinders is deactivated.

9. Control system according to claim 8, further comprising means for also deactivating the exhaust valve of a cylinder of which the intake valve is deactivated.

10. Control system according to claim 8, in which said controlling means includes means for effecting a gradual decrease in the effective cross sectional area of said common air intake passage when switching from all-cylinder operation and for effecting a quick increase in the effective cross sectional area of said common air intake passage where switching from part-cylinder operation to all-cylinder operation.

* * * * *